US006332678B2

(12) United States Patent
Hollands

(10) Patent No.: US 6,332,678 B2
(45) **Date of Patent: *Dec. 25, 2001**

(54) PRINTER HAVING A REST STATION FOR AN INK JET HEAD

(75) Inventor: Peter Joseph Hollands, Baarlo (NL)

(73) Assignee: Oce-Technologies, B.V., Venlo (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/015,940

(22) Filed: Jan. 30, 1998

(30) Foreign Application Priority Data

Jan. 30, 1997 (NL) ..... 1005128

(51) Int. Cl.[7] ..... B41J 2/175; B41J 29/13
(52) U.S. Cl. ..... 347/88; 347/108
(58) Field of Search ..... 347/88, 17, 37, 347/108, 32, 99, 22, 36; 400/689, 690, 713

(56) References Cited

U.S. PATENT DOCUMENTS 4,283,730 * 8/1981 Graf ..... 347/75
4,392,146 * 7/1983 Bovio et al. ..... 347/78
4,577,200 * 3/1986 Rix et al. ..... 347/22
4,791,439 12/1988 Guiles ..... 347/88
5,598,199 * 1/1997 Mielke ..... 347/78

FOREIGN PATENT DOCUMENTS 0644056 3/1995 (EP) .
0704306 4/1996 (EP) .
62-39246 * 2/1987 (JP) ..... 347/88

OTHER PUBLICATIONS

Patent Abstracts of Japan, vol. 018, No. 398 (M–1645), Jul. 26, 1994, Tsutomu et al. "Ink jet recording device". JP 06 115088.

Patent Abstracts of Japan, vol. 096, No. 004, Apr. 30, 1996, Yashusi et al. "Inkjet Recorder", JP 07 323554 A.

* cited by examiner

*Primary Examiner*—N. Le
*Assistant Examiner*—Shih-Wen Hsieh
(74) *Attorney, Agent, or Firm*—Birch, Stewart, Kolasch & Birch, LLP

(57) ABSTRACT

An ink jet system including an ink jet head for the image-wise spraying of hotmelt ink, diode for maintaining the hotmelt ink in a molten state in the ink jet head, a rest station defining an area for at least partially receiving the ink jet head, and a guide system for facilitating the movement of the ink jet head from an operative mode to a standby mode within the rest station.

6 Claims, 1 Drawing Sheet

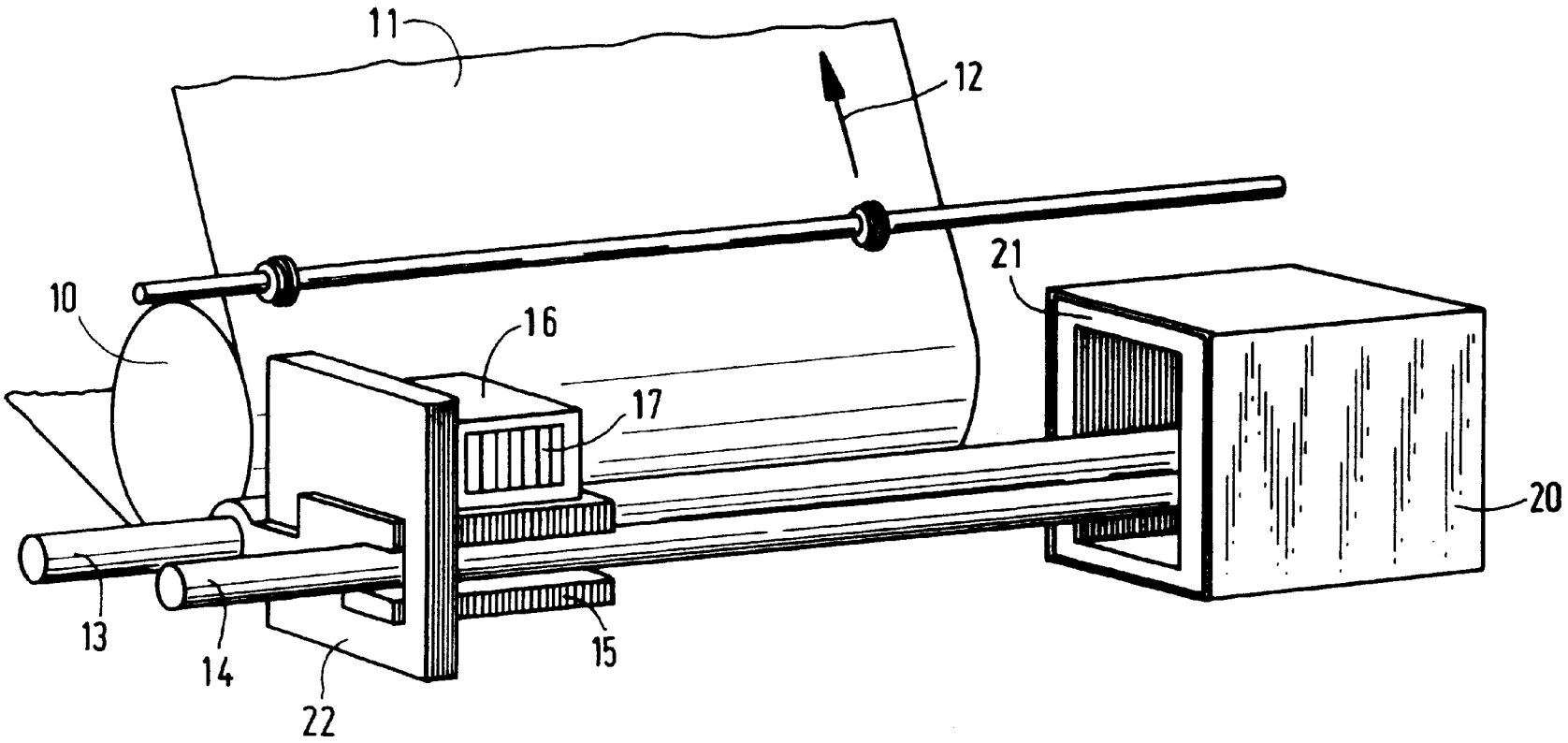
20
21
12
17
15
16
11
22
14
10
13

PRINTER HAVING A REST STATION FOR AN INK JET HEAD

BACKGROUND OF THE INVENTION

The present invention relates to an ink jet system containing an ink jet head for spraying hotmelt ink image-wise, means for keeping the hotmelt ink in a molten state in the head, and a guide system by means of which the head can be moved along a receiving sheet and to a rest station.

The use of hotmelt inks is known, for example, from U.S. Pat. No. 4,791,439, which describes an ink jet head which is filled with ink which is solid at room temperature. This solid ink is melted and brought to a temperature of 100° C. to 150° C. In order to print a receiving sheet with an ink jet head of this kind, the head is placed on a guide system, as described for example in EP-A-0 644 056 and moved perpendicular to the direction of advance of the receiving paper, the image being printed strip-wise on the receiving sheet. A disadvantage of the combined apparatus is that in the standby mode the ink jet head consumes a large amount of unnecessary energy, because the ink must be maintained in the molten state and because the head is exposed to the atmosphere and thus the heat dissipates very quickly to the surroundings.

SUMMARY OF THE INVENTION

Accordingly, an object of the present invention is to obviate or reduce these and other problems experienced by the prior art.

This object is achieved in an ink jet system according to the present invention, in which a rest station (20) is provided which comprises a space in which the ink jet head (16) can be at least partially disposed and which is provided with a heat-insulating material (21). As a result, the ink jet head in the standby mode is provided in a heat-insulated space so that the heat and power loss are reduced to a minimum.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

The FIGURE shows an ink jet system containing an ink jet head which is transferred to a rest station during a standby mode so that heat and power loss can be reduced to a minimum.

DETAILED DESCRIPTION OF THE INVENTION

The FIGURE diagrammatically illustrates a roller 10 containing a receiving sheet 11 which is transported in the direction of arrow 12. A guide system including guide elements 13, 14, is also provided, along which a support element 15 and heat insulating plate 22 can be reciprocally moved by drive means (not shown). An ink jet head 16 is disposed on the support element 15 and is provided with ink via means not shown. The ink is of the hotmelt type, which is solid at room temperature and which is sprayed in thinly a liquid molten state onto the receiving sheet 11 image-wise at a temperature of 100° C. to 150° C. preferably at 130° C. The ink is brought to and maintained at this temperature by heating means 17.

If no further sheets 11 are required to be printed, the support element 15 with the ink jet head 16 disposed thereon is moved to a rest station 20. This is in the form of a closed chamber which is open on one side and which can accommodate completely the support element 15 including the ink jet head 16. The inside of the rest station 20 is provided with a heat-insulating layer 21. A heat-insulating plate 22 is also disposed on the support element 15. In the standby mode, the plate 22 closes off the rest station 20, thermally.

The ink jet head 16 is also provided with a layer of insulation but since the head is adapted to reciprocate, this layer of insulation is relatively thin. No insulation at all can be provided on the side of the head where the nozzles are situated. If an ink jet head of this kind is not in use and is situated outside of the rest station 20, the energy consumption is approximately 25 watts. This consumption is reduced to less than 5 watts if the ink jet head 16 is transferred into the rest station 20.

Any known heat-insulating material can be used as the heat-insulating layer 21, e.g. glass or mineral fiberboard, polystyrene foam, polyurethane foam, and the like.

In the construction illustrated, the support element 15 is also transferred into the rest station in the standby mode. However, it is equally possible to make this support element 15 of heat-insulating material and to use it as the bottom of the rest station 20.

The rest station 20 need not be stationary as in the example described. For example, it can be moved by a mechanical transmission to any place where the ink jet head 16 is situated, above the head, and this is preferably in a position where the head is situated next to the path of the receiving material.

The rest station 20 can be combined with a cleaning device and/or a nozzle shut-off system by means of which any drying of ink in or on the nozzle plate is obviated. The rest station can also be provided with an ink filler by means of which solid ink can be brought into the ink jet head 16.

The rest station 20 can also be provided with a heating means which can be used, for example, for rapidly melting the solid ink in the ink jet head 16 in a starting mode.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet system comprising:

an ink jet head for image-wise spraying of hotmelt ink, means for maintaining the hotmelt ink in a molten state in the ink jet head, a rest station defining an area outside a printing area for at least partially receiving the ink jet head, said rest station being provided with an stationary insulating layer, and a guide system for facilitating movement of the ink jet head from an operative mode with the printing area to a standby mode within the rest station, in which standby mode the ink is kept in a molten state.

2. The ink jet system of claim 1, wherein a receiving sheet is operatively mounted in front of said ink jet head.

3. The ink jet system of claim 1, wherein the guide system comprises:

a heat insulating plate, supporting elements extending from said heat insulating plate for supporting said ink jet head; and guide elements extending across said receiving sheet to said rest station, said heat insulating plate and support elements containing said ink jet head mounted for reciprocal movement on said guide elements across said receiving sheet.

4. The ink jet system of claim 3, wherein in the standby mode, the heat-insulating plate closes the rest station.

5. The ink jet system of claim 3, wherein the support elements are made at least partially of a heat-insulating material.

6. The ink jet system of claim 3 wherein, in the standby mode, the support elements form part of the rest station or partially shut off said rest station.

* * * * *